US006125802A

United States Patent [19]

Pen

[11] Patent Number: 6,125,802

[45] Date of Patent: Oct. 3, 2000

[54] PISTON ENGINE POWERTRAIN

[76] Inventor: Pao Chi Pen, Marbelle Club, 840 S. Collier Blvd., Marco Island, Fla. 34145

[21] Appl. No.: 09/377,863

[22] Filed: Aug. 20, 1999

Related U.S. Application Data

[63] Continuation-in-part of application No. 09/081,787, May 20, 1998.

[51] Int. Cl.[7] ..... F02B 75/04

[52] U.S. Cl. ..... 123/48 B; 123/78 E; 123/197.4

[58] Field of Search ..... 123/197.1, 197.4, 123/48 B, 78 E

[56] References Cited

U.S. PATENT DOCUMENTS

| | | | |
|---|---|---|---|
| 1,309,257 | 7/1919 | Martens | 123/54.3 |
| 1,777,179 | 9/1930 | Perlman | 123/197.1 |
| 2,120,657 | 6/1938 | Tucker | 123/54.3 |
| 4,538,557 | 9/1985 | Kleiner et al. | 123/48 B |
| 5,335,632 | 8/1994 | Hefley | 123/48 B |

*Primary Examiner*—Noah P. Kamen

*Attorney, Agent, or Firm*—Watson Cole Grindle Watson, P.L.L.C.

[57] ABSTRACT

An engine body supports a cylinder having a piston reciprocally mounted therein. A connecting rod is pivotally connected between the piston and a lever which is pivotally supported by the engine body. The lever rotatably supports a drive roller which is disposed in contact with a cam surface on a member drivingly connected to an output shaft. The connecting rod may be connected to the lever by a connecting pin which is mounted for movement within slots formed in the lever. A crank is pivotally connected to the connecting pin to adjust the position of the connecting pin within the slots to control reciprocal movement of the piston. In a modification, the levers connected to adjacent pistons are connected to one another for movement together and are pivoted about a common pivot axis. In another embodiment, a novel cam profile provides unequal piston strokes to operate the engine in an overexpanded operating cycle.

18 Claims, 8 Drawing Sheets

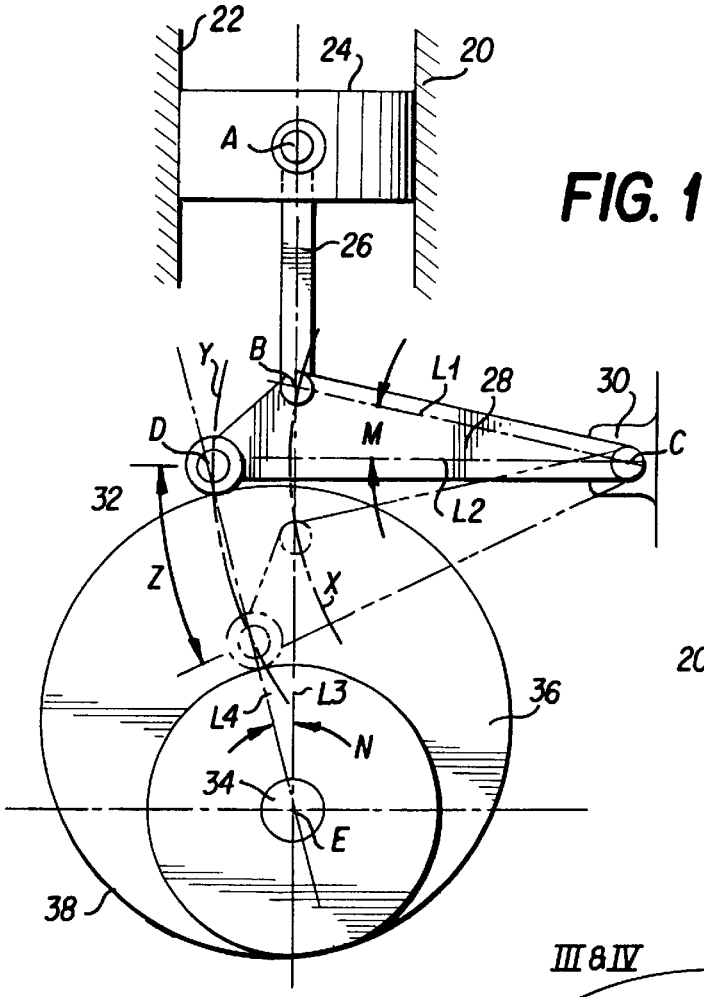
FIG. 1
FIG. 1A
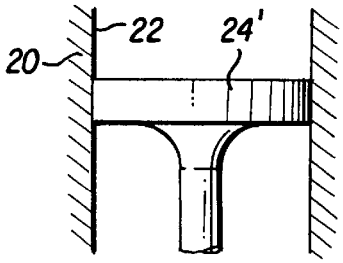
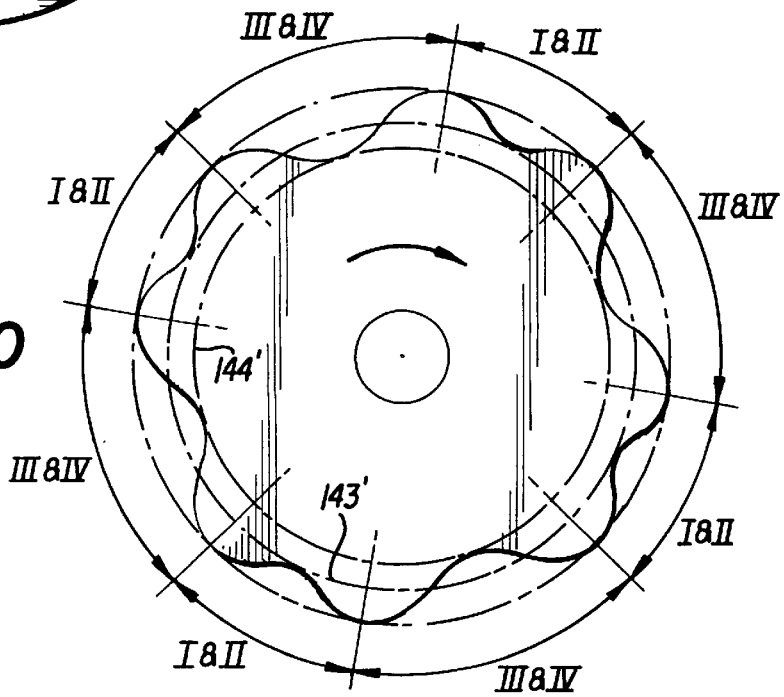
FIG. 20

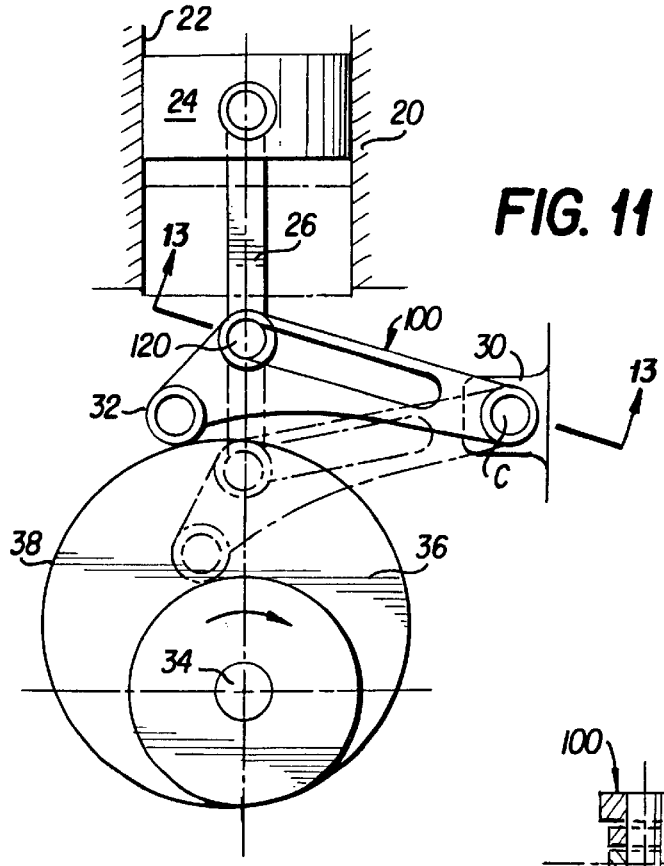
FIG. 11
FIG. 13
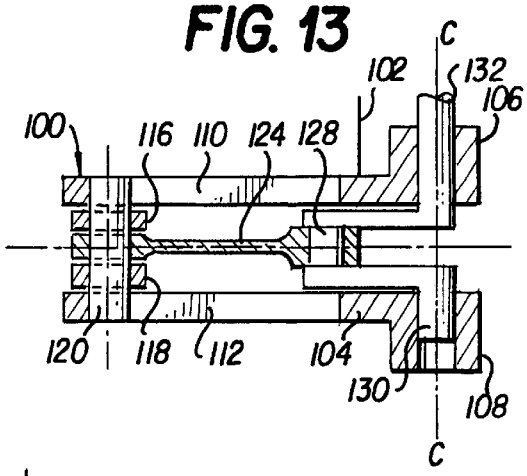
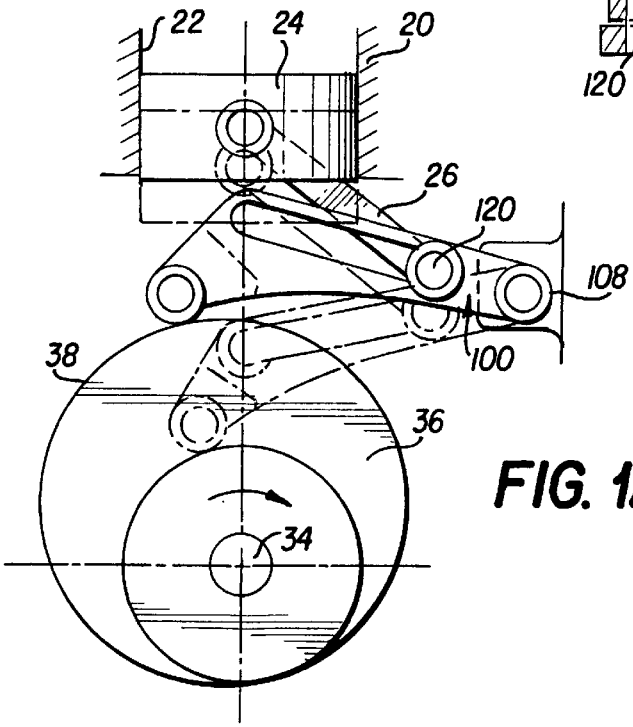
FIG. 12

PISTON ENGINE POWERTRAIN

CROSS-REFERENCE TO RELATED APPLICATION

The present application is a continuation-in-part of copending application Ser. No. 09/081,787, filed May 20, 1998.

BACKGROUND OF THE INVENTION

The present invention relates to a piston engine powertrain, and more particularly to a powertrain which transmits power from a piston of an internal combustion engine to an output shaft. This invention is an improvement over the powertrain disclosed in U.S. Pat. No. 5,626,113, the disclosure of which is incorporated herein by reference.

Conventional powertrains in use with piston engines employ a connecting rod which is pivotally connected between each piston and a crankshaft which is an output shaft. Such constructions have many shortcomings. A very large reciprocating mass is involved, and large friction losses are created. Piston rings and lubrication oil are required within the cylinder. Because lubrication oil may deteriorate, the cylinder wall temperatures cannot be high enough to prevent flame quenching on the cylinder wall. The piston rings create areas where some portion of the fuel in the cylinder may not be burned effectively. The inherent inability of such engines to control the high firing temperature leads to NOx formation, which is very undesirable.

With conventional arrangements utilizing a connecting rod and crankshaft to transmit power, the cylinder volume of a four stroke combustion-ignition (CI) engine varies in a fixed pattern in accordance with the output shaft rotating angle. Therefore, an engine designer does not have the ability to choose an appropriate piston speed for each engine cycle event for the same average piston speed. It is therefore desirable to provide a construction whereby an engine designer has the freedom to choose the piston movement throughout an engine cycle. This is a principal objective of the present invention.

In today's mid-size sedans only one-third of the engine power is required to maintain a highway speed of 70 mph. Full power is only required for quick acceleration and hill climbing. Hybrid engines have been developed wherein extra power provided by an IC engine produces electrical power which may be stored by a battery so that electric power may be used to drive the output shaft only when peak power is provided. Such hybrid engines require additional components and the complexity and cost thereof is substantially increased. However, a conventional six-cylinder engine may accomplish the desired result by deactivating four cylinders when only one-third of the total power of the engine is required.

The high cycle efficiency of an overexpanded cycle has long been recognized. However, such a cycle requires a longer piston stroke for expansion and exhaust processes and a shorter piston stroke for intake and compression processes. This has not been successfully accomplished in the prior art. It is, therefore, an important objective to provide a construction whereby an overexpanded cycle can be obtained.

SUMMARY OF THE INVENTION

The present invention employs a novel powertrain wherein the connecting rod is pivotally connected at one end to a reciprocating piston and is further pivotally connected at the opposite end to a lever. The lever is pivotally supported by the engine body and rotatably supports a drive means in the form of a roller. The roller is disposed in contact with a cam surface on a member which is drivingly connected to an output shaft. This member is preferably the flywheel of the engine, but it may be separate from the flywheel if so desired.

The various axes about which the components rotate or pivot have a unique relationship to one another. The output shaft rotates about a first axis. The lever is mounted for pivotal movement about a second axis. The connecting rod is connected to the lever for pivotal movement about a third axis; and the roller is mounted for rotation about a fourth axis. The distance from the second axis to the fourth axis is fixed at all times, and is always greater than the distance from the second axis to the third axis. The fourth axis moves along an arc having a finite length between the top dead center and bottom dead center positions of the piston. A tangent to the midpoint of the arc passes substantially through the fourth axis of rotation of the output shaft. A first included angle is formed between a line passing through the second axis and the third axis and a line passing through the second axis and the fourth axis. A second included angle is formed between the centerline of the associated cylinder passing through the first axis and the tangent passing through the first axis, the first and second included angles being substantially equal to one another.

This construction is quite different from a connecting rod and crankshaft in that it generates very small side forces between the piston and cylinder wall and therefore there is very small resistance to piston movement. The piston movement can be varied by changing the cam profile. Any number of piston reciprocating cycles per shaft revolution can be obtained by providing a corresponding number of cam lobes as explained hereinafter.

The powertrain of the invention can be applied to a four-stroke CI or spark-ignition (SI) engine with a two-stroke CI engine. A much better engine design can be obtained since an engine designer has the ability to choose an appropriate piston speed for each engine cycle event within the same average piston speed. For example, it is desirable to have a slower piston speed during a combustion process so that a longer time period is obtained to promote a more complete combustion. It is also desirable to have higher piston speeds for compression and expansion processes to reduce heat losses. In the case of a two-stroke CI engine, it is desirable to have a very slow piston speed, even a momentary stop at the bottom dead center position to facilitate a scavenging process. The piston movement throughout an engine cycle can be varied by developing a cam profile which generates the desired piston movement.

Engine design is a process of compromise between various conflicting factors. A particular cylinder volume curve plotted in accordance with output shaft rotating angle can be specially designed to achieve the best compromise between fuel efficiency and pollutant control in any given situation. The present invention enables this to be accomplished.

The invention enables the use of a piston substantially in the form of a disk having a diameter slightly smaller than the bore of the associated cylinder. The clearance between the disk piston and the cylinder wall will not be affected by a small oscillation of the lower end of the piston rod. Gaps across the disk piston will be automatically maintained to allow uneven leakage which creates a large enough pressure differential across the piston to balance the small side forces and the weight component of the piston. The piston is therefore self-lubricated by the leaking gas so that conventional lubrication oil can be eliminated.

As noted above, the cam surface of the invention is preferably provided on the flywheel. The space in which the flywheel is located is sealed airtight. For a four-stroke engine, the mean pressure within this sealed space approaches the mean pressure within a cylinder. During the intake stroke the cylinder pressure is always lower than that in the sealed space. Therefore, there is no possibility for a fresh charge to leak into the sealed space. The sealed space is small and can be considered as a part of the cylinder clearance volume. Since the flow between the sealed space and the cylinder is very restricted, the sealed space constitutes only a small part of the total cylinder clearance volume.

The chemical reaction continues as fuel leaks to the sealed space which functions as a thermal reactor. During an intake stroke, the gas leaks from the sealed space back to the cylinder as recycled exhaust gas and exits the cylinder after another combustion process. Therefore, there is no significant consequence of the gas leakage between the sealed space and the cylinder. For a two-stroke engine, the mean pressure within the sealed space approaches the mean pressure within the exhaust manifold system.

The invention enables the engine power output to be easily changed by cutting a number of cylinders in or out of operation quickly. To maintain perfect engine balance, opposite cylinders can be activated or deactivated at the same time. On average, a pair of opposite cylinders is activated only one-third of the time. Therefore, the engine of a mid-size sedan can last three times longer.

A particular cylinder along with its associated connecting rod and lever can be deactivated quickly. The fuel supply to the cylinder can be cut off and the piston motion stopped to deactivate the cylinder. However, when the fuel supply is cut off, it is desirable that the piston maintain a small amount of reciprocating movement within the cylinder to prevent the idling piston from sticking to the cylinder wall. This is accomplished by providing adjusting means for adjusting the location at which the connecting rod is pivotally connected to the associated lever.

The connecting rod is connected to the lever by a connecting pin which is mounted for movement within slots formed in the lever. The adjusting means includes a crank which is pivotally connected to the connecting pin to adjust the position of the connecting pin within the slots to control reciprocating movement of the piston.

In a modified form of the invention, the pair of levers between two adjacent cylinders and their associated pistons are connected to one another for movement together. The pair of levers are also pivotally supported by the engine body for pivotal movement about a common pivot axis.

In a further embodiment of the invention, a novel cam profile produces intake and compression strokes of each piston which are shorter than the expansion and exhaust strokes. This enables an overexpanded cycle of operation to be obtained, thereby affording a significant advantage over the prior art.

The invention will be explained in detail in the following with reference to the embodiment shown in the drawings.

BRIEF DESCRIPTION OF THE DRAWINGS

FIG. 1 is a diagrammatic view illustrating the principle of operation of the invention;

FIG. 11 is a view similar to FIG. 1 showing the principle of operation of a modified form of the invention;

FIG. 12 is a view similar to FIG. 11 illustrating the components in a different position relative to one another;

FIG. 13 is a sectional view taken along line 13—13 of FIG. 11;

FIG. 20 sows a cam profile with a large number of lobes.

DETAILED DESCRIPTION OF THE PREFERRED EMBODIMENTS

Figure 2:
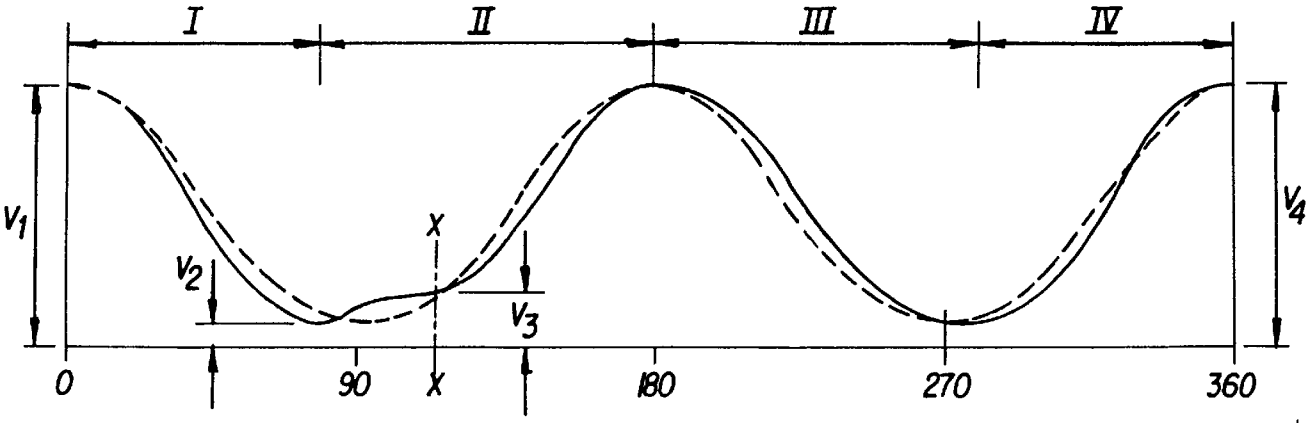
FIG. 2 is a graph showing the cylinder volume of a four-stroke CI engine vs. output shaft rotating angle.

Referring now to the drawings wherein like reference characters designate corresponding parts throughout the several views, there is shown in FIG. 1 a cylinder 20 having a bore 22 therein having a piston 24 mounted for reciprocation therein. These components represent typical components of a conventional internal combustion engine. A connecting rod 26 has the upper end thereof pivotally connected to the piston for pivotal movement about an axis A. The lower end of the connecting rod is pivotally connected to a lever 28 for pivotal movement about an axis B. The lever is pivotally supported by the engine body 30 for pivotal movement about an axis C. The lever supports a drive means 32 in the form of a roller for rotation about an axis D.

An output shaft 34 is rotatable about an axis E and is drivingly connected with a cam 36 having a cam surface 38 on the outer periphery thereof which defines a simple eccentric circle profile relative to the output shaft. The drive roller 32 rolls along cam surface 38. As the piston reciprocates, the drive roller will cause the cam and the output shaft to rotate as the lever moves from the top dead center position of the piston wherein the lever is shown in solid lines to the bottom dead center of the piston wherein the lever is shown in doffed lines.

As the piston reciprocates, axis B oscillates along an arc X having a center of oscillation at axis C, while axis D oscillates along an arc Y also having a center of oscillation at axis C. Arc Y has a finite length Z between the top dead center position of the piston and the bottom dead center position thereof. It is noted that the connecting rod 26 departs very little from the centerline of the cylinder during such oscillatory movement. Furthermore, forces acting on axis C are minimized.

The distance from axis C to axis D is fixed at all times and is always greater than the distance from axis C to axis B. A first included angle M is defined between line L1 passing through axis C and axis B and line L2 passing through axis C and axis D. A second included angle N is defined between the centerline L3 of the cylinder which also passes through axis E and the line L4 which is tangent to arc Y at the midpoint of the length of the arc. Tangent line L4 also passes through axis E.

Piston 24 represents a conventional piston. In the present invention, a conventional piston may be replaced with a modified piston 24' as shown in FIG. 1A which may be termed a disk piston because it resembles a disk since the height thereof is much less than that of a conventional piston thereby significantly reducing the mass of the piston. Piston 24' has a diameter which is slightly smaller than that of the cylinder bore 22. Permanent dry solid film lubricants can be applied to the cylindrical side surface of the piston to reduce wear. As noted previously, such a piston is self-lubricated by gas leaking past the piston during operation.

Referring now to FIG. 2, the cylinder volume of a four-stroke CI engine is shown for various rotating angles of a power output shaft. The dotted line volume curve is generated by a conventional piston engine powertrain utilizing a connecting rod and a crankshaft. This curve cannot be varied. On the other hand, the solid line volume curve is generated by the powertrain of the invention and can be arbitrarily chosen. The rotating angle is divided into four sections indicated by reference characters I, II, III and IV which represent the compression, expansion, exhaust and intake strokes of the engine.

As shown, the solid line curve has a smaller section I allocated to the compression stroke than the dotted line curve so that a high piston speed can be achieved. The solid line curve has a larger section II allocated to the expansion stroke than the dotted line curve to provide a longer period for fuel injection and combustion before the piston acquires a fast speed during the expansion stroke. The solid line curve has a slightly larger section III allocated to the exhaust stroke than the dotted line curve; and the solid line curve has a slightly smaller section IV allocated to the intake stroke than the dotted line curve.

Figure 3:
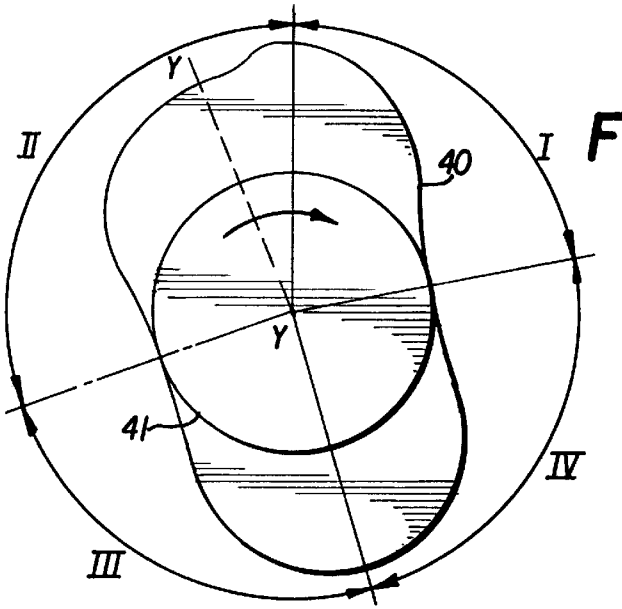
FIG. 3 illustrates a cam profile which produces the volume variations as shown in the solid curve shown in FIG. 2.

FIG. 3 illustrates a four-stroke CI engine cam profile 40 required to generate the solid line volume curve shown in FIG. 2. This cam profile is obtained by plotting the solid line cylinder volume curve of FIG. 2 in polar coordinates on a base circle 41 of appropriate diameter. The volume curve values are multiplied by a factor before plotting the polar coordinates to obtain the required piston stroke. The sections I, II, III and IV of FIG. 2 are indicated on FIG. 3 to illustrate how the roller 32 on lever 28 of FIG. 1 follows the outer contour of cam profile 40 to cause the volume of the cylinder to vary as shown in FIG. 2.

Figure 4:
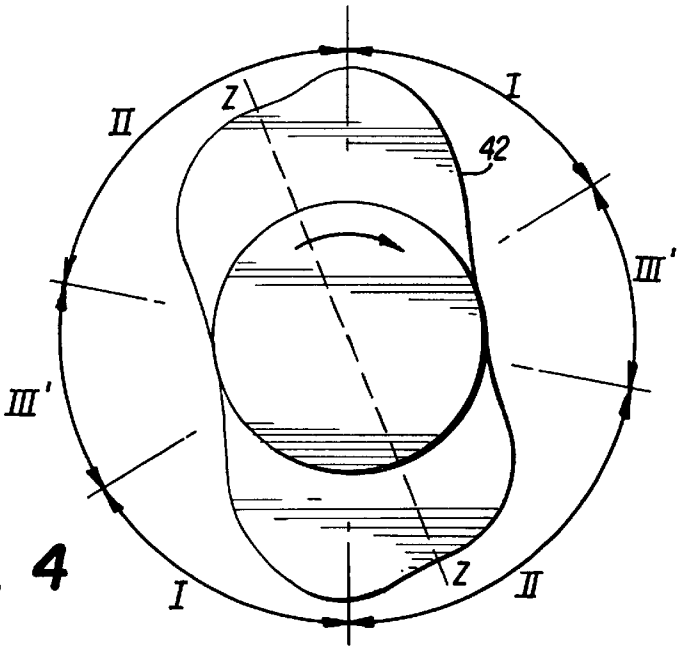
FIG. 4 is a modified cam profile.

FIG. 4 illustrates a cam profile 42 of a two-stroke CI engine. This cam profile has two identical lobes obtained from modifying the cam profile of FIG. 3. The lobe sections corresponding to fuel injection and combustion are substantially the same in FIGS. 3 and 4. A long scavenging section III' as shown in FIG. 4 is achieved by reducing the duration of the compression and expansion sections, as shown. For every shaft revolution, there is one power stroke for a four-stroke engine and two power strokes for a two-stroke engine.

Referring to FIGS. 2, 3 and 4, there is a long fuel injection and combustion duration, the end of which is indicated by dotted lines x—x, y—y and z—z respectively. With a very high compression temperature and a very small starting rate of fuel injection, the effect of ignition delay is minimized. Therefore, a constant pressure combustion process is achievable. Based on a cylinder clearance volume $V_2$ and the total amount of fuel burned per cycle, the volume $V_3$ at the end of a constant pressure combustion process is shown in FIG. 2. A relatively large shaft angle between $V_2$ and $V_3$ is chosen for fuel injection and combustion. By assuming that the fuel injection and combustion take place simultaneously, a constant pressure combustion process can be achieved by coordinating the piston movement with the rate of fuel injection.

Figure 8:
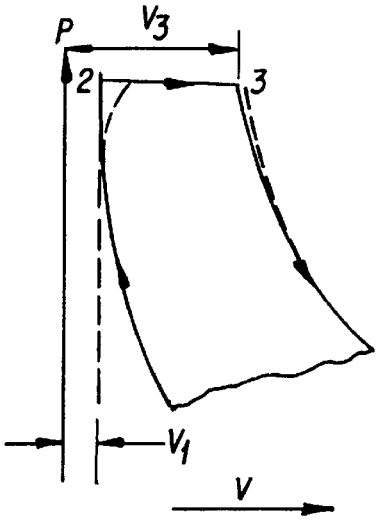
FIG. 8 is a portion of a pressure vs. volume diagram showing the upper portion of a constant-pressure cycle.

Referring to FIG. 8, an enlarged P-V diagram of an upper portion of a constant-pressure cycle is illustrated. If ignition is delayed by a few degrees, the initial part of the firing pressure curve would momentarily retreat along the compression curve and catch up with the constant pressure line when the fuel injected within the delay period is totally burned. The net result of a short ignition delay is a small dip at the beginning of the constant pressure line as shown in FIG. 8. After the ignition, if fuel injection and combustion do not take place simultaneously, the constant pressure line would slope downward slightly as shown by the dofted line. Therefore, an approximate constant-pressure cycle CI engine can be immediately developed.

Since the firing temperature and pressure under a constant-pressure combustion process are much lower than those under a constant volume combustion process, the formation of NOx is minimized. With a long duration of fuel injection into a constant pressure combustion chamber, a precise control of fuel injection for promoting a more complete combustion to reduce CO and HC can be achieved. Therefore, a constant pressure cycle CI engine has the potential of eliminating most of the engine exhaust emissions, especially when disk pistons 24' as shown in FIG. 1A are used to eliminate piston rings and lubrication oil within the cylinder.

Figure 5:
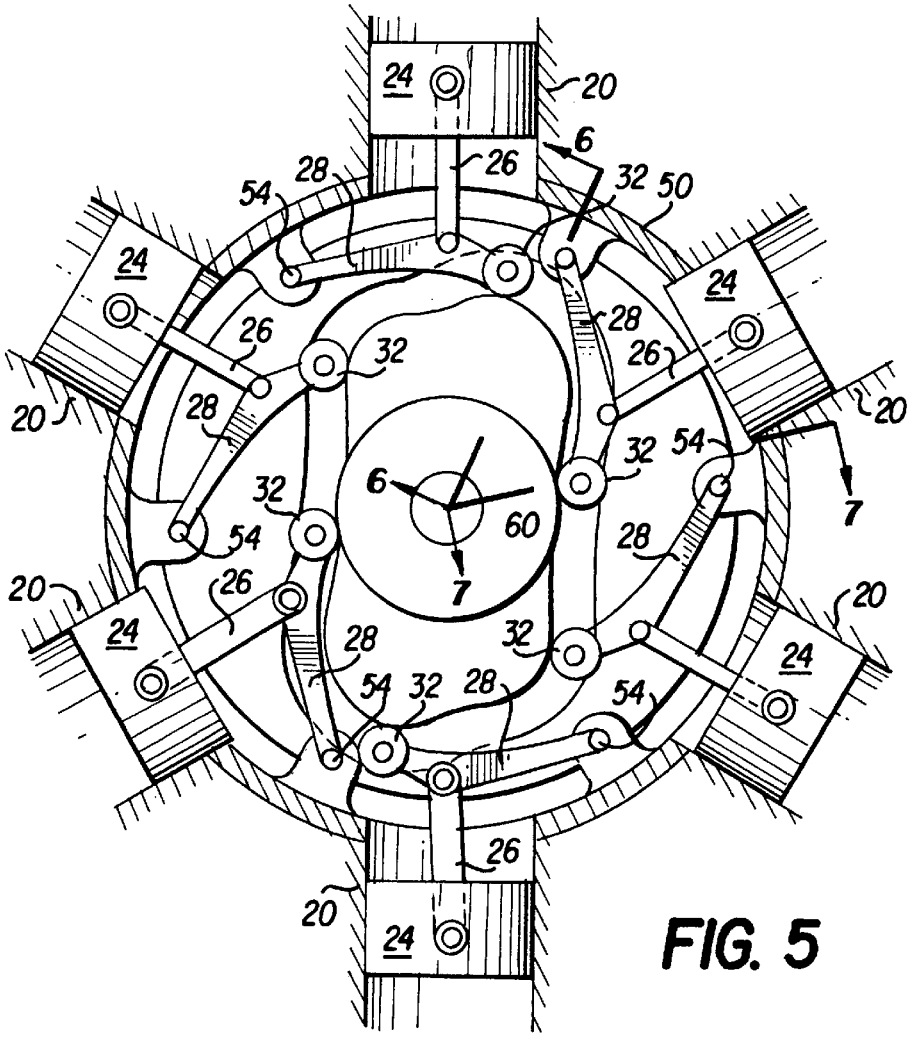
FIG. 5 is a somewhat diagrammatic cross-sectional view of the invention applied to a radial two-stroke CI engine.
Figure 6:
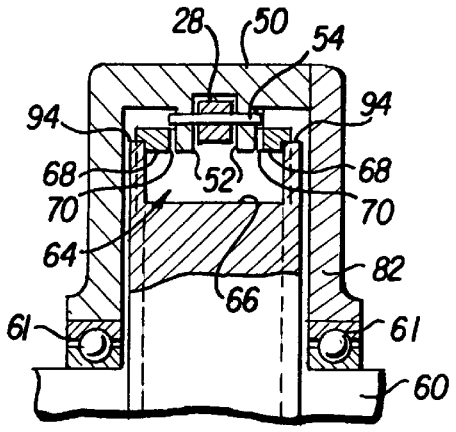
FIG. 6 is a sectional view taken along line 6—6 of FIG. 5.

Referring to FIG. 5, a somewhat diagrammatic sectional view of a first form of the invention applied to a radial two-stroke CI engine is shown. This is a six cylinder engine including six cylinders 20 having six pistons 24 disposed therein for reciprocating movement. Each of the pistons 24 is pivotally connected by connecting rod to one of six levers 28 each of which is pivotally supported by an engine body 50. As seen in FIG. 6, engine body 50 is provided with pairs of spaced radially inwardly extending lugs 52 which have suitable holes formed therethrough for receiving a pivot pin 54 which also extends through a suitable hole formed in the associated lever to pivotally support the lever on the body 50. Each of the levers is pivotally supported in a similar manner on body 50.

Figure 7:
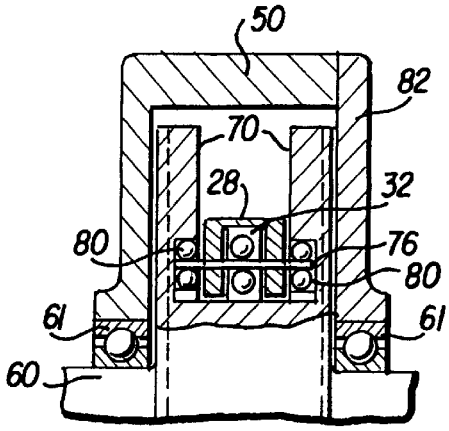
FIG. 7 is a sectional view taken along line 7—7 of FIG. 5.

An output shaft 60 is rotatably supported by bearings 61 carried by engine body 50 as seen in FIGS. 6 and 7. A member 62 is drivingly connected to the output shaft in a conventional manner and preferably is a flywheel. The flywheel has a cam groove indicated generally by reference numeral 64 formed therein and opening at the outer periphery of the flywheel. The cam groove includes a cam surface 66 and a pair of spaced outer guide surfaces 68 which are disposed adjacent spaced surfaces 70 of the flywheel. Surfaces 70 provide a gap therebetween extending around the flywheel which receives lugs 52 as seen in FIG. 6 and which allows the levers to oscillate radially inwardly and outwardly relative to the flywheel.

As seen in FIG. 7, the end of lever 28 is bifurcated to provide a pair of spaced legs 74 which have suitable holes for receiving a pin 76 which rotatably supports drive roller 32. Roller 32 rides along the cam surface 66 which corresponds in contour to the cam profile 42 shown in FIG. 4. Pin 76 also rotatably supports guide rollers 80 at opposite ends of the pin for engaging the guide surfaces 68 which have contours parallel to the contour of cam groove surface 66. In this form of the invention, guide surfaces 68 and guide rollers 80 are necessary to keep drive rollers 32 in contact with cam surface 66. A cover 82 is bolted to engine body 50 by means of bolts (not shown). The flywheel is provided with suitable access means (not shown) for inserting and removing drive rollers 32 and guide rollers 80 into and out of cam groove 64.

Figure 9:
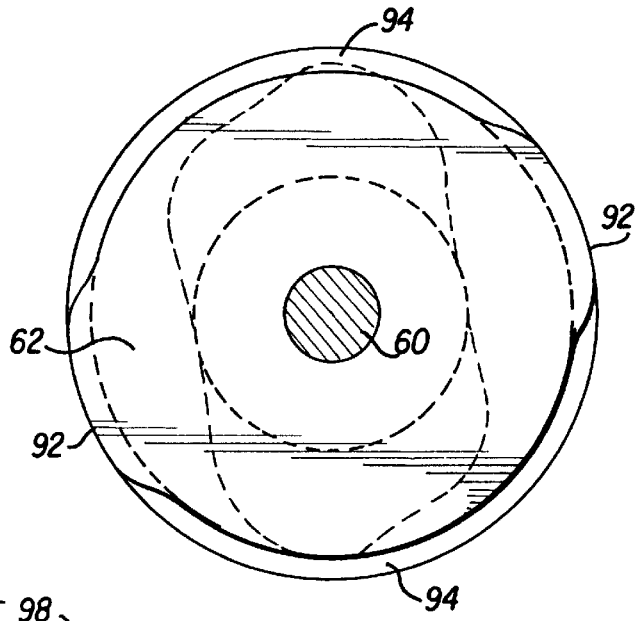
FIG. 9 is a side view of the flywheel of the invention.

There are additionally two similar valve operating cam surfaces formed on the periphery of the flywheel adjacent the opposite faces thereof. As seen in FIG. 9, each of these cam surfaces includes a pair of cam lobes 92 disposed at diametrically opposite portions of the associated face of the flywheel 62 and a pair of recessed portions 94 extending between the cam lobes. Intake valves (not shown) associated with the cylinders of the engine are operated by push rods with roller followers (not shown). The rollers roll along the valve operating cam surfaces comprising portions 92 and 94 during rotation of the flywheel. The depth of recessed portions 94 is a function of the desired valve lift. At the end of a blowdown process, lobes 92 cause the intake valves to quickly open. Scavenging air enters the top of the cylinders through the intake valves and exits through exhaust ports (not shown) at lower portions of the cylinders. Therefore, the two-stroke engine has a volumetric efficiency which approaches that of a four-stroke engine. When two-stroke and four-stroke engines operate at the same rpm, the fuel injection and combustion duration are the same because of the identical lobe sections. Therefore, the two-stroke engine has almost twice as much output as a four-stroke engine, especially when an exhaust gas turbine is used to drive a scavenging air compressor.

Since the output shaft torque is a function of the stroke and the number of power strokes per revolution (the number of cam lobes in the cam groove in the flywheel), it is advantageous to choose a shorter stroke and thus reduce the oscillation angle of the piston rod. For a given cylinder diameter and piston speed, a shorter stroke will also reduce the engine weight. Usually, a two-stroke engine operates at a lower rpm than a four-stroke engine because the two-stroke engine does not have adequate time for proper scavenging. However, the two-stroke engine shown in FIG. 5 can operate at the same rpm as that of a four-stroke engine.

Figure 10:
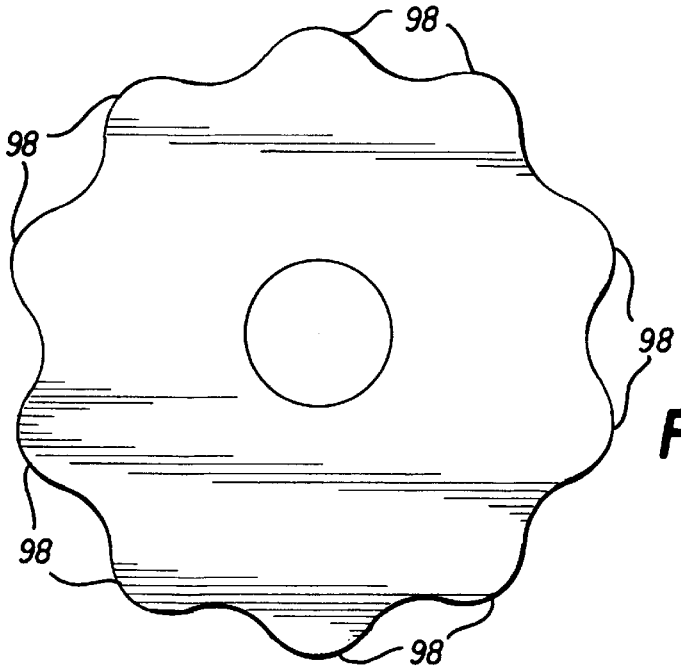
FIG. 10 shows a cam profile with a large number of lobes.

The number of cam lobes on the cam surface of the flywheel of a two-stroke engine can be doubled or tripled by dividing the angular coordinate of the cam profile by an appropriate integral number before plotting on a base circle. A perfect engine balance is achieved by having even numbers of cylinders and lobes. Furthermore, each pair of opposite cylinders can be different from other pairs without jeopardizing the engine balance. Within the limits of allowable piston speed, the engine output can be increased by an increase in the number of lobes on the cam surface. FIG. 10 illustrates a cam surface profile with a large number of lobes 98 which may be employed in marine and stationary power plant applications.

As discussed previously, it may be desirable to deactivate certain pairs of cylinders during operation of an engine as shown in FIG. 5. Because of the constant pressure combustion, the pressure differential across the pistons is relatively small. Therefore, as noted hereinbefore, pistons 24' such as shown in FIG. 1A can be employed. However, for the purpose of starting the engine, one pair of opposite cylinders may employ cylinders 24 as shown in FIG. 5. When starting, fuel is supplied only to the two cylinders having pistons 24 therein. When the engine reaches a high rpm, fuel is discontinued to the two cylinders having pistons 24 therein and is supplied to the cylinders having pistons 24' therein. Fuel may then be supplied again to cylinders having pistons 24 therein only when maximum power is required.

Referring now to FIGS. 11–13, parts similar to those shown in FIG. 1 have been given the same reference characters. In this form of the invention, adjusting means is provided for adjusting the location at which the connecting rod is connected to the lever. As seen in FIG. 13, lever 100 includes two spaced portions 102 and 104 which are respectively connected to tubular portions 106 and 108 suitably supported by the engine body for rotation about axis C—C corresponding to axis C shown in FIG. 1. Portions 102 and 104 have elongated slots 110 and 112 formed therein respectively.

The lower end of connecting rod 26 is bifurcated and includes a pair of spaced portions 116 and 118 which are pivotally connected to lever 100 by a connecting pin 120 which passes through suitable holes formed in rod portions 116 and 118 and which has its opposite ends rotatably and slidably disposed within slots 110 and 112 of the lever .

A connecting member 124 has a hole in one end thereof which receives connecting pin 120 and a hole in the opposite end thereof which receives a crank portion 128 of a crank 130 which is journalled for rotation within tubular portions 106 and 108 of lever 100. The connecting pin and the crank portion 128 are independently rotatable with respect to the connecting member. Part 132 of the crank can be connected to any suitable control means which turns the crank through an arc of 180 degrees at appropriate times during operation of the engine. It is apparent that crank 132 can be turned independently of reciprocation of the lever about the axis C. The crank and connecting member 124 are not shown in FIGS. 11 and 12 for the sake of clarity.

FIG. 11 illustrates the components in normal operating condition wherein the connecting pin 120 is disposed at one end of the slots 110 and 112 in the lever. When it is desired to deactivate cylinder 20, crank 130 is turned through an angle of 180 degrees and the connecting pin 120 is moved into the position shown in FIG. 12 wherein the pin has been moved to the opposite end of slots 110 and 112 in the lever. In this position, a small amount of piston movement is maintained to keep the piston from sticking to the cylinder wall.

To deactivate a cylinder, the fuel supply is first cut off from the cylinder before crank 130 is turned. To reactivate the cylinder, the crank is again turned in the opposite direction to return the connecting pin back to the position shown in FIG. 11, whereupon fuel is again supplied to the cylinder. There is no significant resistance in turning the crank.

Figure 14:
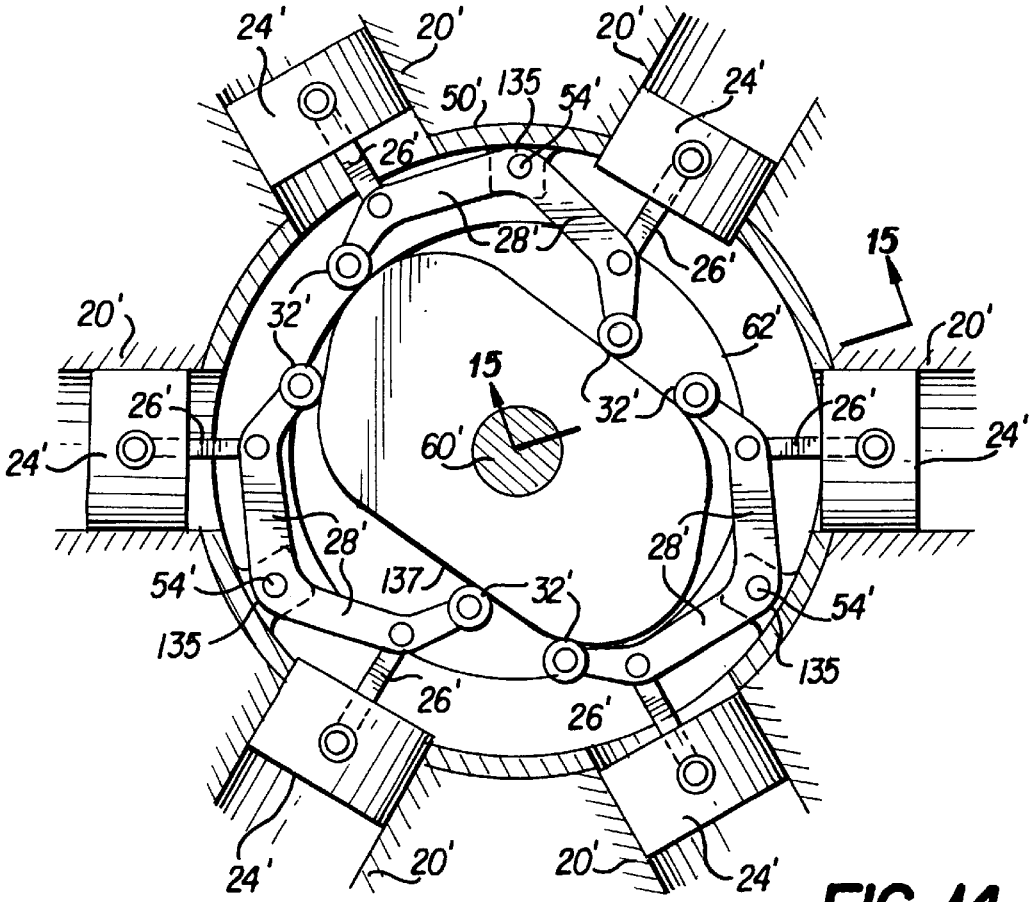
FIG. 14 is a view similar to FIG. 5, but illustrating a modified form of the invention.
Figure 15:
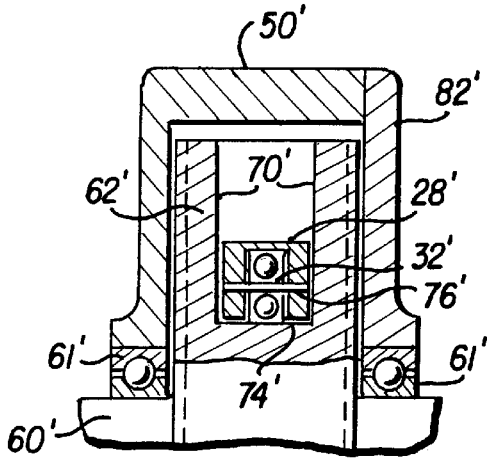
FIG. 15 is a sectional view taken along line 15—15 of FIG. 14.

Referring to FIG. 14, a diagrammatic sectional view of a modified form of the invention applied to a radial two-stroke engine is shown. In this figure, parts corresponding to those in FIG. 5 are indicated by the same reference numerals primed.

Three pivot pins 54' are supported by engine body 50', each pivot pin being disposed between adjacent pairs of cylinders 20'. Each pivot pin pivotally supports a pair of levers 28' for pivotal movement about a common pivot axis. Each pair of levers supported by one of pivot pins 54' is of such construction that the two levers are of the same length and are connected to one another for movement together, thereby effectively forming a single pivoting yoke 135 which is pivotally connected to a pair of adjacent pistons and which rotatably carries a pair of drive rollers 32' at opposite ends of the yoke.

The angle between two lines from the pivot axis of pivot pin 54' to the axes of rotation of two associated rollers 32' is defined as the first yoke angle. The first yoke angle as seen in FIG. 14 is 90 degrees. The angle between two lines from the pivot axis of pivot pin 54' to the pivot axes where associated connecting rods 26' are pivotally connected to levers 28' is defined as the second yoke angle. The second yoke angle is 120 degrees.

With the foregoing yoke angles and the cam surface profile shown in FIG. 14, the drive rollers 32' on each yoke 135 remain in contact with the cam surface 137 on flywheel 62'; and the movement of the pair of pistons 24' interconnected with each yoke are opposite to one another. That is to say that one of the pistons of each such pair of pistons moves radially inwardly while the other of the pistons moves radially outwardly. Accordingly, there is no requirement for guide surfaces 68 and guide rollers 80 as in the first form of the invention shown in FIGS. 5–7 to keep the drive rollers in contact with the cam surface on the flywheel.

The number of lobes in FIG. 14 can be chosen other than two. For a three-lobed cam, the first yoke angle must be changed from 90 to 120 degrees without changing the second yoke angle. When the number of yokes is reduced from three to two with four cylinders, the second yoke angle must be 90 instead of 120 degrees. With two lobes and one yoke, a two-cylinder V-type engine is obtained. In this case, the second yoke angle or V angle can be freely chosen. There is great flexibility in choosing the numbers of lobes and yokes to meet the needs of different engine output at different rpm's.

To deactivate a pair of cylinders having a pair of pistons linked to one yoke, means may be provided (not shown) to rotate the pivot pin 54' along a circular arc with its center at the center of the drive shaft to pull the pair of pistons toward the center of the drive shaft. The fuel supply to these cylinders is cut off before moving the pivot pin. As a result of movement of the pivot pin, the cylinder clearance volumes in the pair of cylinders are greatly increased to reduce the negative compression work. To reactivate this pair of cylinders, the pivot pin 54' is moved back to its original position. Then, the fuel is re-supplied to the pair of cylinders.

Figure 16:
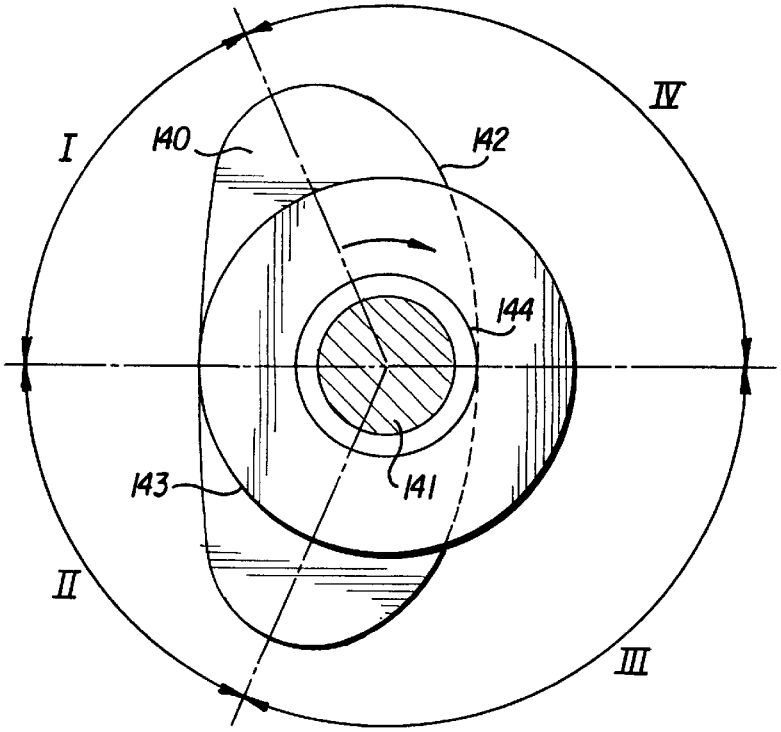
FIG. 16 illustrates a novel cam profile which creates unequal piston strokes.

Referring to FIG. 16, an embodiment of the invention is illustrated using a novel cam profile to provide an overexpanded operating cycle. This cam profile is utilized with the powertrain shown in FIG. 5 of the drawings. Member 140 which is connected to the output shaft 141 has outer cam profile 142 which as seen in FIG. 16 consists of four sections, I, II, III, and IV corresponding to intake, compression, expansion and exhaust strokes respectively. The cam profile has two base circles 143 and 144 with different diameters, the profile including two lobes. Cam profile sections I and II with the larger base circle 143 provide shorter intake and compression strokes, while sections III and IV with the smaller base circle 144 provide longer expansion and exhaust strokes.

Figure 17:
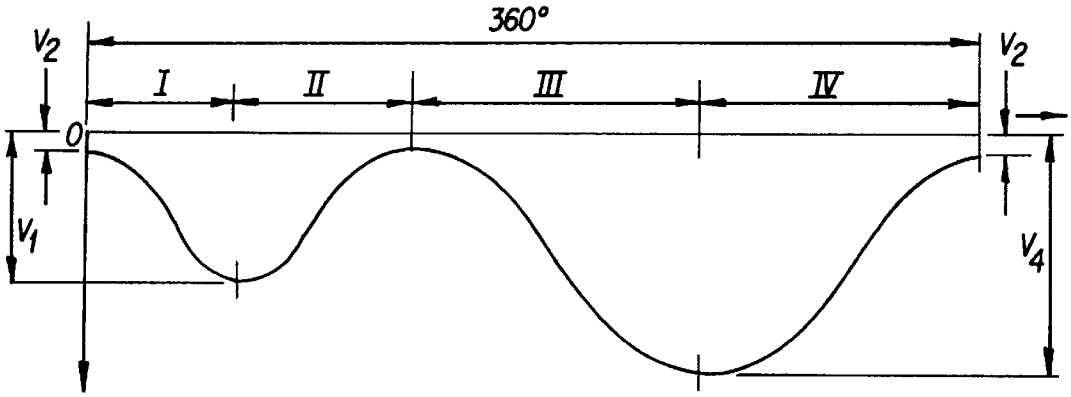
FIG. 17 is a graph showing the cylinder volume of a four-stroke engine vs. Output shaft rotating angle.

FIG. 17 is a graph showing the cylinder volume of a four-stroke engine vs. Output shaft rotation angle, where $V_2$ is the cylinder clearance volume, $V_1$ is the cylinder volume at the end of an intake stroke, and $V_4$ is the cylinder volume at the end of an expansion stroke. Because $V_4$ is much larger than $V_1$, the expansion ratio is much higher than the compression ratio. Shaft angles allocated to various strokes are proportional to stroke lengths as shown, so that average piston speeds over four strokes are about equal. This powertrain providing unequal piston strokes can be applied to either a constant-volume cycle SI engine or a constant-pressure cycle CI engine.

Figure 18:
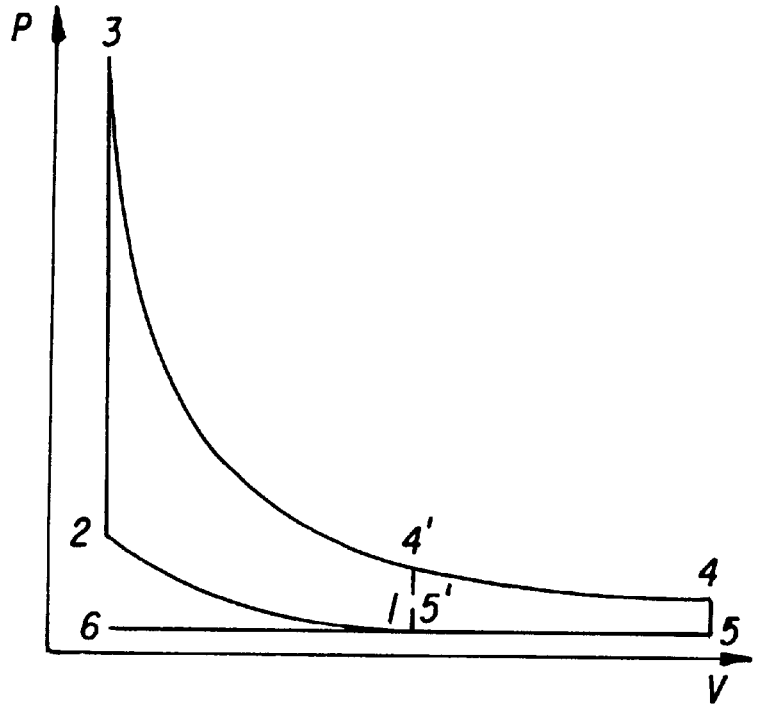
FIG. 18 shows P-V diagrams of an overexpanded constant-volume ideal air cycle and a constant-volume ideal air cycle.

FIG. 18 is a P-V diagram of an overexpanded constant-volume ideal air cycle (1234561) with a compression ratio $r_c$ of 8 and an expansion ratio $r_e$ of 16. An expansion ratio of 16 is chosen for high efficiency. A smaller compression ratio of 8 is chosen to avoid detonation. With a lower compression ratio, cheaper regular gasoline can be used to operate the engine. A constant-volume ideal air cycle (1234'5'61) is also shown in FIG. 18 for comparison. For Q=1200 BTU/Ibm, efficiencies are 0.565 and 0.657 for the constant-volume ideal air cycle and the overexpanded constant-volume ideal air cycle respectively. The maximum cycle pressure is equal to 1790 psia and the maximum temperature is 8248° for both cycles. The overexpanded constant-volume ideal air cycle achieves 16% greater ideal cycle efficiency than the constant-volume ideal air cycle.

Figure 19:
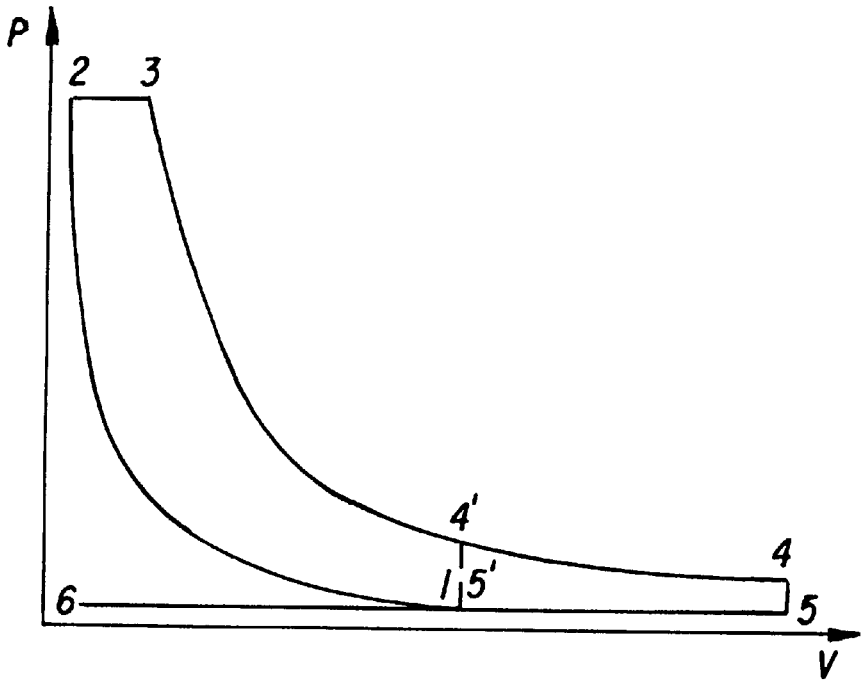
FIG. 19 shows P-V diagrams of an overexpanded constant-pressure ideal air cycle and a constant-pressure ideal air cycle.

FIG. 19 shows a P-V diagram of an overexpanded constant-pressure ideal air cycle (1234561) with a compression ratio $r_c$ of 20 and an expansion ratio $r_e$ of arbitrarily chosen for illustration. A relatively high $r_c$ value generates a compression pressure of 974 psia and a temperature of 1790° which are helpful for starting an engine at cold temperature. A constant-pressure ideal air cycle (1234'5'61) is also shown in the same figure for comparison. The maximum cycle temperature is 52900 based on Q=840 (O.70×1200) BTU/Ibm. The constant pressure ideal air cycle efficiency is 0.608 while the overexpanded constant-pressure ideal air cycle efficiency is 0.685. At reduced load with Q=600BTU/lbm, the overexpanded constant-pressure cycle has a maximum cycle temperature of 4290°R and an efficiency of 0.696. Compared with a constant volume ideal air cycle SI engine, the overexpanded constant-pressure ideal air cycle CI engine has more than 20% higher efficiency with 3000°R lower firing temperature. Even though these results are based on ideal air cycles, the relative advantages of an overexpanded constant-pressure cycle CI engine over any existing automotive engines should not be overlooked.

If it is desired, the lost engine capacity due to shortened intake and compression strokes can be compensated with a higher intake pressure. Cylinder pressure is already relatively low when the piston reaches the overextended stroke portion of the cycle. Side forces generated between the cam surface and cam followers are directly transmitted to the engine frame rather than through the piston and cylinder wall. Piston skirt length can be reduced accordingly. Therefore, only a small amount of extra cylinder bore is required to accommodate the overexpanded stroke without a significant change in piston-cylinder assembly and engine weight.

The maximum pressure of a constant-pressure cycle engine is equal to the compression pressure. Therefore, piston pressure loading is moderate and thus requires fewer piston rings. Lighter connecting rods and shorter piston skirts lead to a small reciprocating mass. Light reciprocating mass and small piston pressure loading make the design of the powertrain less taxing. Smaller reciprocating mass and less piston resistance also permit a higher piston speed to further reduce the engine specific weight. All these factors improve greatly engine brake efficiency and specific power.

Any number of cam lobe pairs can be derived from the cam profile in FIG. 16 by dividing the angular coordinate by an integral number and plotting on a large enough base circle. On a smaller scale, FIG. 20 shows such a cam profile with four pairs of cam lobes derived from the cam profile of FIG. 16. There are four groups of four-stroke cycles per shaft revolution. Each group consists of two sections I and II with a larger base circle 143' providing two short strokes for intake and compression processes and two sections III and IV with a smaller base circle 144' providing two long strokes for expansion and exhaust processes. Instead of two piston strokes, there are sixteen strokes per cylinder per shaft revolution. Therefore, an equivalent gear-box with a gear ratio of eight is automatically built in. Any other gear ratio can be achieved by choosing an appropriate number of lobe pairs. For marine application, a high rpm is required to reduce engine specific weight and a low rpm to increase propeller efficiency. These conflicting requirements are automatically met without the usual separate gear-box. A large total power output for ship propulsion can be obtained by having many cylinders installed along the circumference. If necessary, several banks of cylinders can be placed along the shaft length. A piston engine with a built-in gear box can also have aviation applications.

For a SI engine, the current practice to reduce the NOx formation is to recycle the exhaust gas to increase the heat capacity of the contents of the cylinder, so that the firing temperature can be lowered. However, such practice reduces engine capacity and adds complexity to the engine. A SI engine having a powertrain according to the invention may utilize a limited-temperature cycle to control the maximum cycle temperature. The limited temperature combustion process can be controlled by coordinating the piston movement with the rate of heat release after the spark ignition. The rate of heat release after the spark ignition can be obtained from an indicator diagram. The rate of heat release can be reduced by appropriate combustion chamber shape and location of spark plug.

The invention has been described with reference to a preferred embodiment. Obviously, various modifications, alterations, and other embodiments will occur to others upon reading and understanding this specification. It is my intention to include all such modifications, alterations, and alternate embodiments insofar as they come within the scope of the appended claims, or the equivalent thereof.

I claim:

1. A piston engine powertrain comprising, an engine body, a cylinder supported by said engine body and having a centerline, a piston mounted for reciprocation within said cylinder, a connecting rod having opposite ends, one of said ends being pivotally connected to said piston, a power output shaft rotatable about a first axis, a member drivingly connected to said output shaft and having a cam surface thereon, a lever supported by said engine body for pivotal movement about a second axis, the opposite end of said connecting rod being connected to said lever for pivotal movement about a third axis, and drive means supported by said lever for rotation about a fourth axis, said drive means being disposed in contact with said cam surface, the distance from said second axis to said fourth axis being fixed at all times and always being greater than the distance from said second axis to said third axis, said fourth axis moving along an arc having a finite length between the top dead center position of said piston and the bottom dead center position of said piston, a tangent to the midpoint of said arc passing substantially through said first axis, a first included angle being defined between a line passing through said second axis and said third axis and a line passing through said second axis and said fourth axis, a second included angle being defined between said center line of the cylinder which passes substantially through said first axis and a line coinciding with said tangent, said first included angle being substantially equal to said second included angle, whereby said third axis oscillates along an arc which deviates only slightly from said cylinder centerline.

2. A powertrain as defined in claim 1 including adjusting means for adjusting the location at which the connecting rod is pivotally connected to said lever.

3. A powertrain as defined in claim 2 wherein said adjusting means includes slot means formed in said lever, the opposite end of said connecting rod being pivotally connected to said lever by a connecting pin, said connecting pin being movably disposed within said slot means, said adjusting means including a rotatable crank means.

4. A powertrain as defined in claim 3 wherein said adjusting means includes a connecting member connected between said connecting pin and said crank means, said connecting pin and said crank means being independently rotatable with respect to said connecting member.

5. A powertrain as defined in claim 1 wherein said cam surface defines an intake portion, a compression portion, an expansion portion and an exhaust portion corresponding to the intake, compression, expansion and exhaust strokes of said piston, said cam surface being configured to provide unequal piston strokes.

6. A powertrain as defined in claim 5 wherein said intake and compression strokes are shorter than said expansion and exhaust strokes.

7. A powertrain as defined in claim 6 wherein said intake and compression portions have a first base circle, said expansion and exhaust portions having a second base circle, said first base circle having a greater diameter than said second base circle.

8. A powertrain as defined in claim 5 wherein said cam surface defines two lobes or a multiple of two lobes.

9. A piston engine powertrain comprising, an engine body, a plurality of cylinders supported by said engine body, a plurality of pistons, each of said pistons being mounted for reciprocation within one of said cylinders, a plurality of connecting rods each of which has opposite ends, one of the ends of each connecting rod being connected to one of said pistons, a power output shaft rotatable about a first axis, a member drivingly connected to said output shaft and having a cam surface thereon, a plurality of levers each of which is supported by said engine body for pivotal movement by said engine body for pivotal movement about a second axis, the opposite end of each of said connecting rods being connected to one of said levers for pivotal movement about a third axis, a plurality of drive means each of which is supported by one of said levers for rotation about a fourth axis, all of said drive means being disposed in contact with said cam surface at spaced points therealong, the distance from the second axis to the fourth axis of each lever being fixed at all times and always being greater than the distance from said second axis to said third axis of each lever, said fourth axis of each lever moving along an arc having a finite length between the top dead center position of said piston and the bottom dead center position of said piston, a tangent to the midpoint of the arc defined by the fourth axis of each lever passing substantially through said first axis, a first included angle being defined between a line passing through said second axis and said third axis and a line passing through said second axis and said fourth axis of each lever, a second included angle being defined between said center line of the cylinder which passes substantially through said first axis and a line coinciding with said tangent of each lever, said first included angle of each lever being substantially equal to said second included angle of each lever, whereby the third axis of each of said levers oscillates along an arc which deviates only slightly from the centerline of the associated cylinder.

10. A powertrain as defined in claim 9 including a pair of additional cam surfaces formed at opposite sides of said member, said additional cam surfaces including cam lobes for engaging followers on push rods to operate intake valves of associated cylinders.

11. A powertrain as defined in claim 9 including a plurality of adjusting means each of which is adapted to adjust the location at which one of said connecting rods is pivotally connected to one of said levers.

12. A powertrain as defined in claim 11 wherein each of said adjusting means includes slot means formed in the associated lever, the opposite end of one of said connecting rods being pivotally connected to the associated lever by a connecting pin, said connecting pin being movably disposed within the associated slot means, each of said adjusting means including a crank means which is independently rotatable about the third axis of the associated lever.

13. A powertrain as defined in claim 12 wherein each of said adjusting means includes a connecting member connected between the associated connecting pin and the associated crank means, the associated connecting pin and the associated crank means being independently rotatable with respect to the associated connecting member.

14. A powertrain as defined in claim 9 wherein said cam surface defines an intake portion, a compression portion, an expansion portion and an exhaust portion corresponding to the intake, compression, expansion and exhaust strokes of said piston, said cam surface being configured to provide unequal piston strokes.

15. A powertrain as defined in claim 14 wherein said intake and compression strokes are shorter than said expansion and exhaust strokes.

16. A powertrain as defined in claim 15 wherein said intake and compression portions have a first base circle, said expansion and exhaust portions having a second base circle, said first base circle having a greater diameter than said second base circle.

17. A powertrain as defined in claim 14 wherein said cam surface defines two lobes.

18. A powertrain as defined in claim 14 wherein said cam surface defines a multiple of two lobes.

* * * * *